United States Patent [19]

Steinfeld

[11] 4,051,977

[45] Oct. 4, 1977

[54] PILL AND WATER DISPENSER

[75] Inventor: Carolyn VeAlletto Steinfeld, New York, N.Y.

[73] Assignee: Lawrence Peska Assoc., New York, N.Y. ; a part interest

[21] Appl. No.: 677,048

[22] Filed: Apr. 14, 1976

[51] Int. Cl.[2] ..... G07F 11/14

[52] U.S. Cl. ..... 221/96; 206/216; 206/217

[58] Field of Search ..... 222/192, 562, 563; 221/266, 310, 307, 220, 96; 215/6; 220/20, 23; 206/217, 537, 38

[56] References Cited

U.S. PATENT DOCUMENTS

| | | | |
|---|---|---|---|
| 2,215,161 | 9/1940 | Sapery | 215/6 X |
| 2,766,796 | 10/1956 | Tupper | 220/23 X |
| 3,637,109 | 1/1972 | Stifter | 221/310 |
| 3,762,539 | 10/1973 | Kerr | 206/537 |

FOREIGN PATENT DOCUMENTS

| | | | |
|---|---|---|---|
| 112,605 | 12/1968 | Denmark | 206/537 |

*Primary Examiner*—Robert B. Reeves
*Assistant Examiner*—Norman L. Stack, Jr.

[57] ABSTRACT

A dispenser for holding and dispensing pills and water is disclosed comprising a tube having a pill chamber and a water chamber, a pill dispensing member being received by the pill chamber and a water dispensing member being received by the water chamber. The water dispensing member is used to seal the water chamber. The pill dispensing member contains a resilient member for biasing pills outwardly of the pill dispenser, a retainer being provided at the top of the pill dispenser to prevent the pills from being forced out of the top of the dispenser. A cap is provided on the pill dispenser having arms that extend through the retainer to grip the uppermost pill resiliently biased towards the retainer so that when the cap is used to seal the end of the pill dispenser and then removed, a pill is taken through the retainer and held in the cap.

7 Claims, 3 Drawing Figures

FIG.1
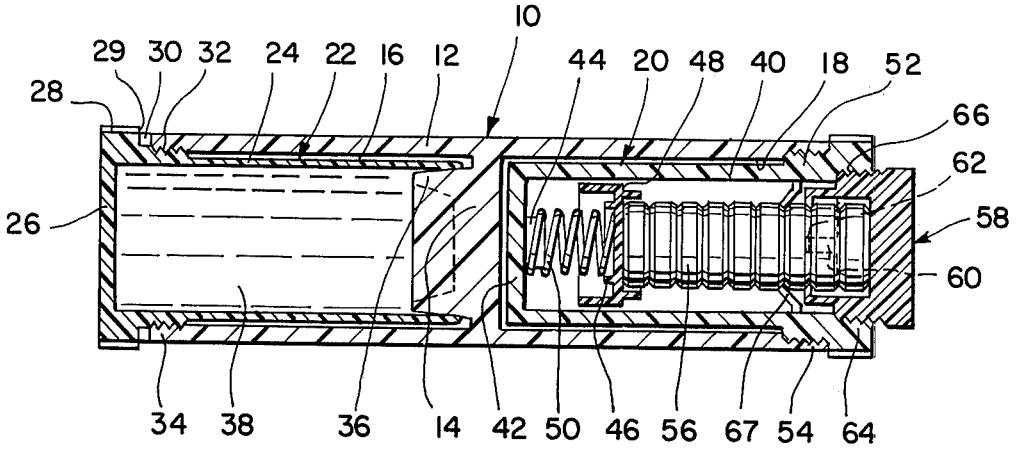
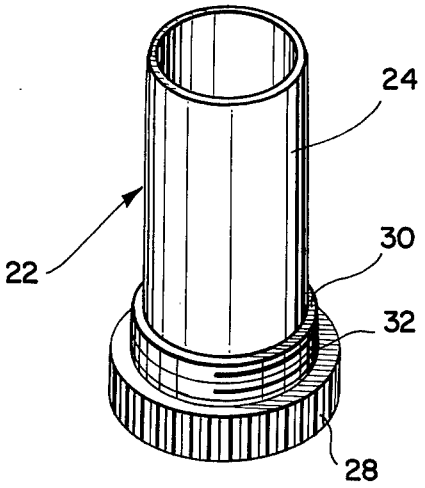
FIG.2
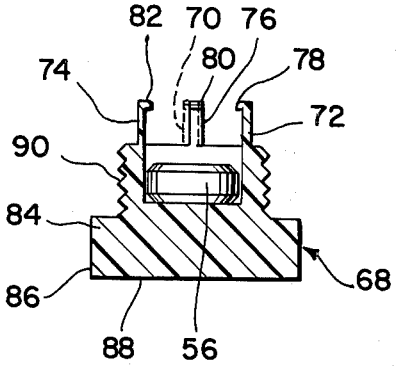
FIG.3

PILL AND WATER DISPENSER

SUMMARY OF THE INVENTION

The present invention relates to a dispenser for holding and dispensing pills and water comprising a tube, the ends of the tube being open. A bulkhead is positioned in the tube for dividing the tube into a water chamber and a pill chamber. An openable and closeable pill dispensing member is received by the pill chamber, a water dispensing member being received by the water chamber. The botttom of the water dispensing member comprises a cap for the water chamber whereby the water chamber and water dispensing member is sealed when the water dispensing member is received by the water chamber.

The water dispensing member comprises a water receptacle having a bottom wall and side walls along with a sealing member at the bottom of the side wall for sealingly engaging the water chamber.

In one embodiment the sealing member comprises screw threads on the water receptacle for threadably engaging mating screw threads on the water chamber, a washer also being positioned adjacent the threads for forming a water-tight seal between the bottom wall of the water receptacle and the end of the water chamber. In a further embodiment the water receptacle is positioned in the water chamber and the bulkhead projects outwardly into the water receptacle and sealingly engages the water receptacle.

The pill dispensing member comprises a pill receptacle having a bottom wall and side walls extending from the bottom wall, a resilient member being positioned in the pill receptacle for resiliently biasing pills upwardly from the bottom wall of the pill receptacle. A retaining member is positioned at the top of the side walls of the pill receptacle for preventing pills from being biased out of the pill receptacle. A cap seals the top of the pill receptacle, a clip member extending from the cap into the pill receptacle for gripping a pill through the retaining member and for pulling a pill through the retaining member when the cap is positioned to close the pill receptacle and then afterwards the cap removed to open the pill receptacle. Screw threads are placed on the pill receptacle for threadably engaging mating screw threads on the pill chamber, threads also being provided on the pill receptacle for threadably engaging mating threads on the cap.

BRIEF DESCRIPTION OF THE SEVERAL VIEWS OF THE DRAWING

FIG. 1 is a side elevation in section illustrating a dispenser for holding and dispersing pills and water according to one embodiment of the present invention.

FIG. 2 comprises a perspective view of a water receptacle for insertion into a water chamber in the dispenser for holding and dispensing pills according to another embodiment of the present invention.

FIG. 3 is a side elevation in section illustrating a cap for closing and opening a pill receptacle insertable in a dispenser for holding and dispensing pills and water, the cap having clips thereon for gripping a pill in such a dispenser and for removing the pill from the dispenser when the cap is placed thereon and then removed according to another embodiment of the present invention.

DETAILED DESCRIPTION

Pill containers and dispensers are disclosed in the prior art U.S. Pat. Nos. 3,526,317, Vanders; 3,526,316, Kalogris; 2,759,598, Tregilgas; and 2,707,522, Matthiesen. U.S. Pat. No. 3,033,420, Thomas, et al., discloses a method and apparatus for dispensing liquids.

None of the foregoing reference discloses a dispenser having separable pill dispensing and liquid dispensing members to facilitate filling the dispenser and further none of the aforementioned references address the difficulty people people have taking pills several times in the course of a day and finding water to wash down medication in the form of a pill.

It is therefore an object of the present invention to overcome these and other difficulties encountered in the prior art.

It is a further object of the present invention to make water accessible to people who carry pills in conventional pill boxes in order to aid them in swallowing such pills.

These and other difficulties have been overcome by the present invention and will become apparent from the disclosure and claims that follow as well as the appended drawing.

Referring to the drawing in FIGS. 1–3, a dispenser for holding and dispensing pills 10 is illustrated comprising a tube 12 having a bulkhead 14 positioned in the tube to divide the tube into a water chamber 16 and a pill chamber 18. A pill dispensing member 20 is received by the pill chamber 18 and a water dispensing member 22 is received by the water chamber 16. The water dispensing member comprises a receptacle having a bottom wall 26 with side walls 24 extending therefrom. A flange 29 extends from the bottom wall 26, knurls 28 being cut in the flange to provide an easily grippable surface. Washer 30 is positioned adjacent the screw threads 32 cut into the side wall 24, mating screw threads 34 being cut into the side wall of the water chamber 16. A plug 36 extends from the bulkhead 14 and sealingly engages the end of the side wall 24 to further seal the water receptacle received by the water chamber 16.

A pill dispensing member 20 is inserted in the pill chamber 18, the dispensing member 20 comprising a receptacle having a bottom wall 42 extending upwardly into side walls 40, a spring retaining member 44 being secured to bottom wall 42 and a spring retaining member 46 being secured to a pill tray 48 movable in the pill dispensing member 20, a spring 50 being employed to resiliently bias pills 56 upwardly and out of the pill dispensing member 20. Screw threads 52 are positioned around the top of the pill dispensing member 20 and threadably engage mating screw threads 54 cut inside the upper portion of the wall of pill chamber 18 to thereby threadably secure pill dispensing member 20 inside of the chamber 18. A retainer comprising a flexible flange 67 projects outwardly from the upper inner wall 40 for retaining tablets 56 resiliently biased out of the opening provided in pill dispensing member 20. Retaining member 67 can comprise a flexible O-ring made of rubber, polyvinyl chloride and the like.

A cap 58 having screw threads 66 for threadable engaging mating screw threads 64 on the inside of the side wall 40 are provided, clips 60 extending downward into the pill dispensing member 20 through the retaining member 67 and around the uppermost pill in the column to be dispensed by means of a hooklike projection 62 on the end of clip 60. A cap 68 illustrated in FIG. 3 shows a plurality of clips 72, 74, 76 and a portion of a clip 70, the clips 72, 74 and 76 having hooks 78, 80 and 82 illustrated projecting outwardly therefrom for gripping a pill inside of a pill dispensing member 20. The cap 68 has screw threads 90 for threadable engaging screw threads 64 on the pill dispensing member 20, cap 68 having a bottom wall 88 and a side wall 86 provided on the periphery of flange 84.

In use, water is placed in water dispensing member 22 and the water chamber 16 of tube 10 placed over receptacle 22 and turned until threads 34 and 32 are engaged sufficiently to seat washer 30 on the outer extremity of the open end of tube 10. In this operation plug 36 also seals the open end of water dispensing member 22.

Tablets are placed on tray 46 through the opening in retainer 67 of the pill dispensing member 20 a sufficient number of pills being placed on tray 46 to compress spring 50 so that spring 50 resiliently biases pills 56 out of the opening in dispensing member 20. Cap 58 is turned in the opening at the end of dispensing member 20 so that threads 66 and 64 threadably engage one another and the resilient clip 60 having hook projection 62 at the end thereof, grips one of the pills after which cap 58 is removed and a pill pulled through the flexible retainer 67 and is made available for consumption.

Throughout the specification and claims, the pills referred to include any tablet or capsule no matter what a shape, the clips, and especially resilient clips 60, 70, 72, 74 and 76 being arranged to grippably engage such pills.

Although the invention has been described by reference to some embodiments, it is not intended that the novel dispenser be limited thereby but that modifications thereof are intended to be included as falling within the broad scope and spirit of the foregoing disclosure, the following claims and the appended drawing.

What is claimed is:

1. A dispenser for holding and dispensing pills and water comprising tube means, the ends of said tube being open, bulkhead means in said tube for dividing said tube into a water chamber and a pill chamber, openable and closable pill dispensing means received by said pill chamber, water dispensing means received by said water chamber, the bottom of said water dispensing means comprising a cap for said water chamber whereby said water chamber and water dispenser is sealed when said water dispenser is received by said water chamber, said pill dispensing means comprising a pill receptacle having bottom wall means and side wall means, resilient means in said pill dispensing means for biasing pills upwardly from said bottom wall, retaining means at the top of said side walls for preventing pills in said pill receptacle from being biased out of said pill receptacle, cap means for sealing the top of said pill receptacle, clip means extending from said cap into said pill receptacle for gripping a pill through said retaining means and for pulling a pill through said retaining means when said cap is positioned to close said pill receptacle and removed to open said pill receptacle.

2. The dispenser of claim 1 where said water dispensing means comprises a water receptacle having bottom wall means and side wall means, sealing means at the bottom of said side wall for sealingly engaging said water chamber.

3. The dispenser of claim 2 where said sealing means comprises thread means on said water receptacle for threadable engaging thread means on said water chamber, washer means adjacent said thread means for forming a water tight seal between said bottom wall and said end of said water chamber.

4. The dispenser of claim 3 where said water receptacle is positioned in said water chamber.

5. The dispenser of claim 4 where said bulkhead projects outwardly into said water receptacle and sealingly engages said water receptacle.

6. The dispenser of claim 5 further comprising first thread means on said pill receptacle for threadably engaging thread means on said pill chamber.

7. The dispenser of claim 6 further comprising second thread means on said pill receptacle for threadably engaging thread means on said cap means.

* * * * *